US012539008B2

(12) United States Patent
Yang

(10) Patent No.: US 12,539,008 B2
(45) Date of Patent: Feb. 3, 2026

(54) BIDIRECTIONAL-SPIN CLEANING STRUCTURE

(71) Applicant: ZHEJIANG PRULDE ELECTRIC APPLIANCE CO., LTD., Zhejiang (CN)

(72) Inventor: Weiming Yang, Jinhua (CN)

(73) Assignee: ZHEJIANG PRULDE ELECTRIC APPLIANCE CO., LTD., Jinhua (CN)

( * ) Notice: Subject to any disclaimer, the term of this patent is extended or adjusted under 35 U.S.C. 154(b) by 312 days.

(21) Appl. No.: 18/216,184

(22) Filed: Jun. 29, 2023

(65) Prior Publication Data

US 2023/0337886 A1 Oct. 26, 2023

Related U.S. Application Data

(63) Continuation of application No. PCT/CN2021/125051, filed on Oct. 20, 2021.

(30) Foreign Application Priority Data

Jan. 19, 2021 (CN) ..... 202120139770.X

(51) Int. Cl.
*A47L 11/40* (2006.01)
*A47L 11/282* (2006.01)

(52) U.S. Cl.
CPC ..... *A47L 11/4069* (2013.01); *A47L 11/282* (2013.01); *A47L 11/4038* (2013.01)

(58) Field of Classification Search
CPC .... A47L 11/283; A47L 13/20; A47L 11/4038; A46D 1/00
See application file for complete search history.

(56) References Cited

U.S. PATENT DOCUMENTS 5,692,808 A * 12/1997 Heuvelman ..... A46D 1/055 15/1
5,806,132 A * 9/1998 Kelley ..... A47L 11/4069 451/353

(Continued)

FOREIGN PATENT DOCUMENTS

CH 374459 A 1/1964
CN 101210372 A 7/2008

(Continued)

OTHER PUBLICATIONS

May 14, 2024 extended Search Report issued in European Patent Application No. 21920661.2.

(Continued)

*Primary Examiner* — Michael D Jennings
(74) *Attorney, Agent, or Firm* — Oliff PLC

(57) ABSTRACT

Disclosed is a bidirectional-spin cleaning structure which relates to cleaning equipment, including an inner-race cleaning disc and an outer-race cleaning disc, the inner-race cleaning disc is surrounded by the outer-race cleaning disc, an inner shaft is vertically fixed on the inner-race cleaning disc, an inner-race gear is mounted on the inner shaft, an outer shaft configured like a circular tube and rotatable about a center line of the inner shaft is sleeved outside the inner shaft, the outer shaft is securely attached to the outer-race cleaning disc, and an outer-race gear rotatable together with the outer shaft is mounted on the outer shaft; an autorotation-only transmission gear is engaged on the outer-race gear, a autorotation-only-only idle gear is engaged between the transmission gear and the inner-race gear; the bidirectional-spin cleaning structure further comprises a power mechanism configured to drive the transmission gear to rotate.

6 Claims, 2 Drawing Sheets

(56) References Cited

U.S. PATENT DOCUMENTS

| | | | | |
|---|---|---|---|---|
| 6,032,313 | A | 3/2000 | Tsang | |
| 8,214,963 | B2 * | 7/2012 | Yu | A47L 13/14 15/228 |
| 8,316,502 | B2 * | 11/2012 | Shao | A47L 13/14 15/119.1 |
| 8,739,347 | B2 * | 6/2014 | Lin | A47L 13/58 74/29 |
| 2010/0242200 | A1 * | 9/2010 | Chen | A47L 13/44 15/229.6 |
| 2012/0118319 | A1 * | 5/2012 | Stuchlik | A47L 11/4044 15/364 |
| 2013/0206172 | A1 | 8/2013 | Bjar et al. | |
| 2015/0183407 | A1 * | 7/2015 | Pak | B60S 3/042 15/21.1 |
| 2018/0206691 | A1 * | 7/2018 | Jang | A47L 11/4011 |
| 2019/0328202 | A1 * | 10/2019 | Yang | A47L 11/4088 |

FOREIGN PATENT DOCUMENTS

| | | | | |
|---|---|---|---|---|
| CN | 211433437 | U | 9/2020 | |
| CN | 212465934 | U | 2/2021 | |
| DE | 318309 | C | 1/1920 | |
| JP | H11-235558 | A | 8/1999 | |
| KR | 101404625 | B1 | 6/2014 | |
| WO | WO-2011005027 | A2 * | 1/2011 | A47L 11/16 |

OTHER PUBLICATIONS

Jan. 24, 2022 International Search Report issued in International Patent Application No. PCT/CN2021/125051.

Jan. 24, 2022 Written Opinion of the International Searching Authority issued in International Patent Application No. PCT/CN2021/125051.

* cited by examiner

BIDIRECTIONAL-SPIN CLEANING STRUCTURE

FIELD

The disclosure pertains to the technical field of cleaning equipment, and more particularly relates to a bidirectional-spin cleaning structure.

BACKGROUND

Tools such as a mop are generally used to clean ground and floor surfaces, ship decks, and the like. Traditional mops have an unsatisfactory cleaning effect; in addition, they have to be pulled and dragged back and forth, which are laborious in use. To address the labor challenge, automatic mops with an automatically spinnable mop head emerge in the market, which offer a better cleaning effect and a more convenient use compared with conventional mops. However, for existing automatic spin mops, their mop head can only spin along one way such that their job of cleaning stubborn stains is not so satisfactory, which can hardly achieve a desired cleaning effect.

SUMMARY

The disclosure provides a bidirectional-spin cleaning structure to address the drawbacks in conventional technologies where the mop head of an automatic mop can only spin along one way with an unsatisfactory cleaning effect; in the cleaning structure provided by the disclosure, an inner-race cleaning disc and an outer-race cleaning disc can spin synchronously towards opposite directions, whereby a better cleaning effect is achieved.

An objective of the disclosure is achieved by a technical solution below: a bidirectional-spin cleaning structure, comprising: an inner-race cleaning disc, an outer-race cleaning disc, and a power mechanism, wherein the inner-race cleaning disc is surrounded by the outer-race cleaning disc, and the power mechanism actuates the inner-race cleaning disc and the outer-race cleaning disc to rotate synchronously towards opposite directions, whereby bidirectional spinning is enabled. In the solution above, the power mechanism can actuate the inner-race cleaning disc and the outer-race cleaning disc to spin synchronously towards opposite directions, whereby bidirectional spinning is enabled; compared with a cleaning disc which can only spin along one way, the present disclosure offers a better cleaning effect. In addition, since the inner-race cleaning disc and the outer-race cleaning disc spin towards opposite directions, the displacement tendencies generated by the spinning inner-race cleaning disc and outer-race cleaning disc may be substantially counteracted, which significantly reduces the displacement tendency generated by the spinning cleaning structure during the cleaning operation, allowing for the cleaning structure to maintain stable during the cleaning operation, which facilitates reduction of the force that needs to be applied by the user against the cleaning structure in operation for maintaining positional stability of the cleaning structure, whereby user experience is enhanced. Furthermore, since the inner-race cleaning disc and the outer-race cleaning disc spin towards opposite directions, the inner-race cleaning disc and the outer-race cleaning disc enables bidirectional mopping, facilitating enhancement of cleaning effect; in addition, the cleaning lines are more uniform, avoiding circular traces left when the cleaning operation is complete.

Preferably, an autorotation-only inner shaft is vertically disposed on the inner-race cleaning disc, an inner-race gear rotatable together with the inner shaft is mounted on the inner shaft, an outer shaft configured like a circular tube and rotatable about a center line of the inner shaft is sleeved outside the inner shaft, the outer shaft is attached to the outer-race cleaning disc, an outer-race gear rotatable together with the outer shaft is mounted on the outer shaft, and the power mechanism actuates the inner shaft and the outer shaft to rotate towards opposite directions via the inner-race gear and the outer-race gear, allowing for the inner-race cleaning disc and the outer-race cleaning disc to spin towards opposite directions.

Preferably, the outer-race gear is engaged with an autorotation-only transmission gear, an autorotation-only idle gear is engaged between the transmission gear and the inner-race gear, and the power mechanism actuates the outer-race gear and the inner-race gear to rotate towards opposite directions via the transmission gear and the idle gear, allowing for the inner shaft and the outer shaft to rotate towards opposite directions.

Preferably, the bidirectional-spin cleaning structure further comprises an autorotation-only first transmission shaft, the transmission gear being securely provided on the first transmission shaft.

Preferably, the power mechanism comprises an electric motor, a driving gear being securely provided on an output shaft of the electric motor, a driven gear secured on the first transmission shaft being engaged on the driving gear, the driven gear and the transmission gear being co-axially arranged.

Preferably, the outer-race cleaning disc comprises a cleaning ring of an annular configuration, a connecting plate being securely attached to an upper end of the cleaning ring, a through-hole configured for the inner shaft to pass through being provided in the center of the connecting plate, a connecting ring being securely attached to an upper end of the connecting plate, the cleaning ring, the through-hole, and the connecting ring being co-axially arranged, a lower end of the outer shaft being securely connected to the connecting ring; the inner-race cleaning disc being surrounded by the cleaning ring.

Preferably, the bidirectional-spin cleaning structure further comprises an autorotation-only second transmission shaft, the idle gear being securely provided on the second transmission shaft.

Preferably, a lower end face of the inner-race cleaning disc is in flush with a lower end face of the outer-race cleaning disc. The inner-race cleaning disc and the outer-race cleaning disc disposed as such do not interference with each other while spinning; and this reasonable design offers a better cleaning effect.

Preferably, the inner-race gear is securely attached to the inner shaft, and the outer-race gear is securely attached to the outer shaft.

Compared with the prior art, the disclosure offers the following benefits: the inner-race cleaning disc and the outer-race cleaning disc can spin synchronously along opposite directions, whereby bidirectional spinning is enabled with a better cleaning effect. The displacement tendencies generated by the spinning inner-race cleaning disc and outer-race cleaning disc may be substantially counteracted, which effectively reduces the displacement tendency generated by the spinning cleaning structure during the cleaning operation, allowing for the cleaning structure to maintain stable during the cleaning operation, which facilitates reduction of the force needs to be applied by the user against the cleaning structure in operation for maintaining positional stability of the cleaning structure, whereby user experience is enhanced.

REFERENCE NUMERALS

1. inner-race cleaning disc; 2. outer-race cleaning disc; 3. first transmission shaft; 4. second transmission shaft; 5. inner shaft; 6. inner-race gear; 7. outer shaft; 8. outer-race gear; 9. transmission gear; 10. idle gear; 11. electric motor; 12. driving gear; 13. driven gear; 14. cleaning ring; 15. connecting plate; 16. through-hole; 18. connecting ring.

DETAILED DESCRIPTION

Hereinafter, the disclosure will be further described through the embodiments with reference to the accompanying drawings.

Embodiment 1

Figure 1:
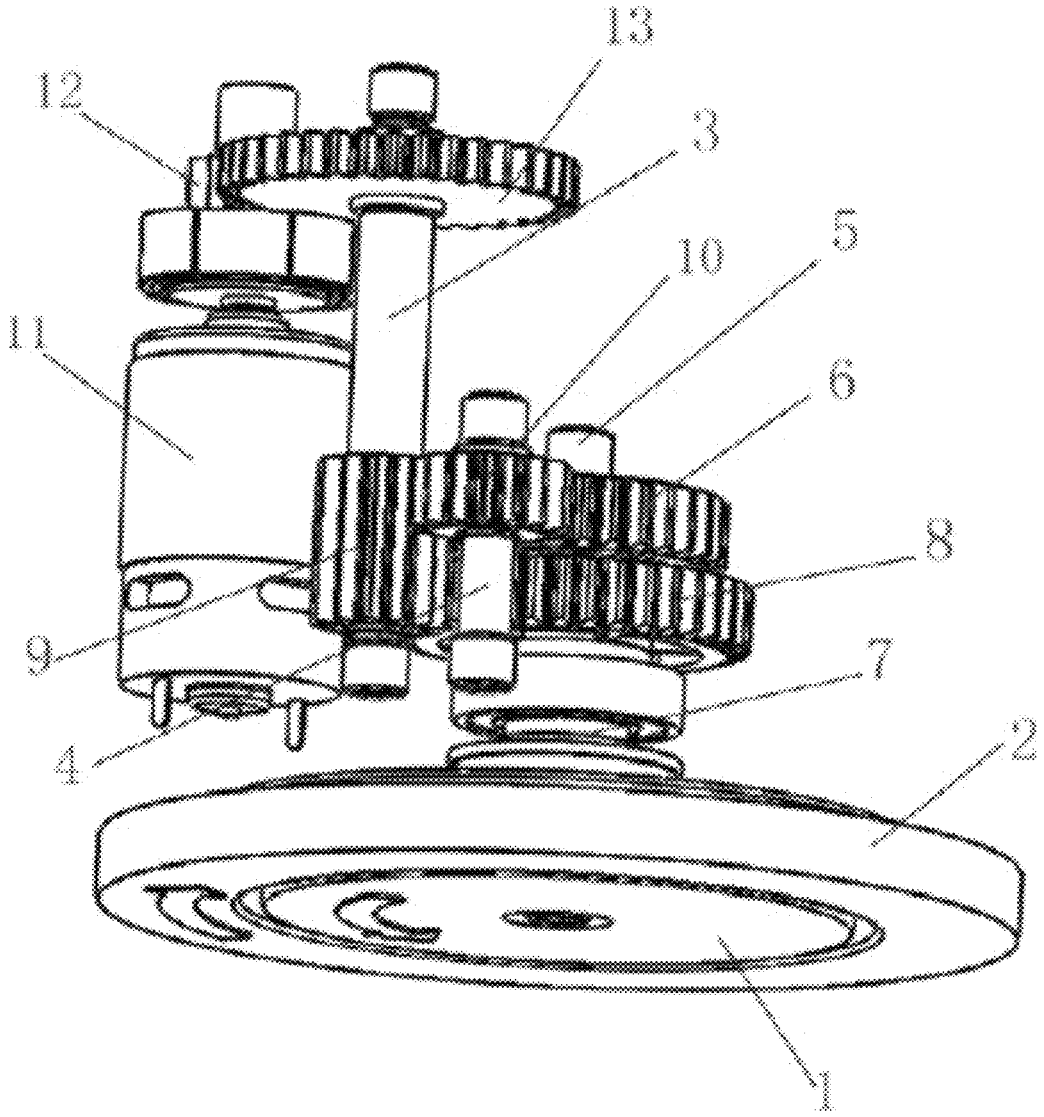
FIG. 1 is a stereoscopic view of the disclosure.
Figure 2:
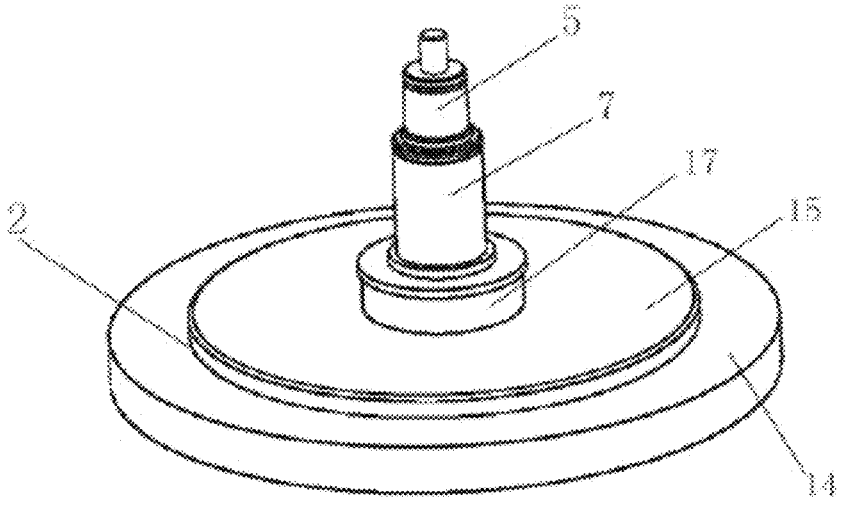
FIG. 2 is a stereoscopic view showing a connection structure with respect to the inner shaft, the outer shaft, the inner-race cleaning disc, and the outer-race cleaning disc.
Figure 3:
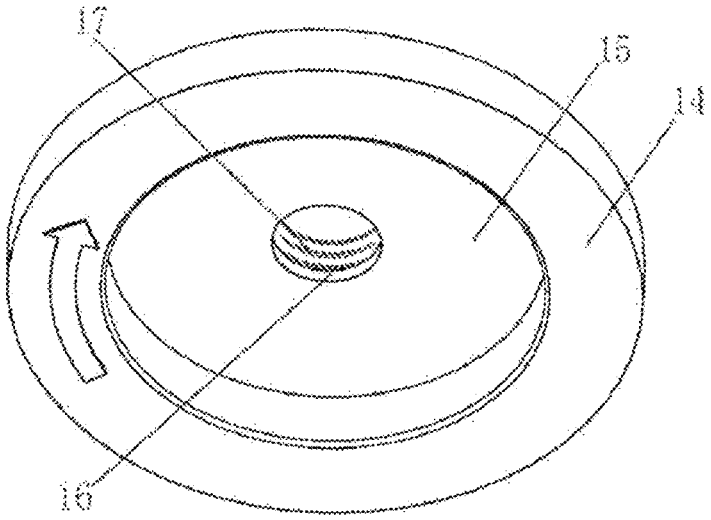
FIG. 3 is a stereoscopic view of the outer-race cleaning disc.

FIGS. 1, 2, and 3 illustrate a bidirectional-spin cleaning structure, comprising: an inner-race cleaning disc 1, an outer-race cleaning disc 2, an autorotation-only first transmission shaft 3, and an autorotation-only second transmission shaft 4, wherein the first transmission shaft 3 is parallel to the second transmission shaft 4, the inner-race cleaning disc 1 is surrounded by the outer-race cleaning disc 2, an autorotation-only inner shaft 5 is vertically fixed on the inner-race cleaning disc 1, an inner-race gear 6 rotatable together with the inner shaft 5 is mounted on the inner shaft 5, an outer shaft 7 configured like a circular tube and rotatable about a center line of the inner shaft 5 is sleeved outside the inner shaft 5, the outer shaft 7 is securely attached to the outer-race cleaning disc 2, and an outer-race gear 8 rotatable together with the outer shaft 7 is mounted on the outer shaft 7; an autorotation-only transmission gear 9 is engaged on the outer-race gear 8, and the transmission gear 9 is securely provided on the first transmission shaft 3. An autorotation-only idle gear 10 is engaged between the transmission gear 9 and the inner-race gear 6, and the idle gear 10 is securely provided on the second transmission shaft 4. The bidirectional-spin cleaning structure further comprises a power mechanism configured to actuate the transmission gear 9 to rotate. The power mechanism comprises an electric motor 11, a driving gear 12 is provided on an output shaft of the electric motor 11, a driven gear 13 secured on the first transmission shaft 3 is engaged on the driving gear 12, the driven gear 13 and the transmission gear 9 are co-axially arranged.

The outer-race cleaning disc 2 comprises a cleaning ring 14 of an annular configuration, a connecting plate 15 is securely attached to an upper end of the cleaning ring 14, a through-hole 16 configured for the inner shaft 5 to pass through is provided in the center of the connecting plate 15, a connecting ring 17 is securely attached to an upper end of the connecting plate 15, the cleaning ring 14, the through-hole 16, and the connecting ring 17 are co-axially arranged, a lower end of the outer shaft 7 is securely connected to the connecting ring 17; the inner-race cleaning disc 1 is surrounded by the cleaning ring 14. A lower end face of the inner-race cleaning disc 1 is in flush with a lower end face of the outer-race cleaning disc 2.

The bidirectional-spin cleaning structure according to the disclosure is installed on an automatic cleaning apparatus such as an automatic mop or an automatic cleaning machine; the first transmission shaft 3, the second transmission shaft 4, the inner shaft 5, and the outer shaft 7 can only be auto-rotationally mounted on the automatic cleaning apparatus. During operation of the disclosure, the electric motor 11 actuates the driving gear 12 to rotate, the driving gear 12 brings the driven gear 13 to rotate, the driven gear 13 drives the first transmission shaft 3 to rotate, the first transmission shaft 3 brings the transmission gear 9 to rotate, while the transmission gear 9 drives the idle gear 10 and the outer-race gear 8 to rotate, and the idle gear 10 brings the inner-race gear 6 to rotate; at this point, the inner-race gear 6 and the outer-race gear 8 rotate towards opposite directions; the inner-race gear 6 and the outer-race gear 8 further bring the inner shaft 5 and the outer-shaft 7 to rotate, respectively. finally driving the inner-race cleaning disc 1 and the outer-race cleaning disc 2 to spin synchronously towards opposite directions, whereby bidirectional spinning is enabled with a better achieving effect.

It is understood that the inner-race cleaning disc 1 may be securely connected to the inner shaft 5 or detachably connected to the inner shaft 5. Likewise, the outer-race cleaning disc 2 may be securely connected to the outer shaft 7 or detachably connected to the outer shaft 7.

The specific embodiments described herein are only exemplary illustrations of the spirit of the disclosure. Those skilled in the related art may make various modifications or supplements or similar substitutions with respect to the specific embodiments described, without departing from the spirit of the disclosure or extending beyond the scope defined in the appended claims.

I claim:

1. A bidirectional-spin cleaning structure, comprising:

an inner-race cleaning disc, an outer-race cleaning disc, a power mechanism, the power mechanism comprising an electric motor, a driving gear provided on an output shaft of the electric motor, and a driven gear secured to a first transmission shaft and engaged with the driving gear, a transmission gear connected to the first transmission shaft, an inner shaft attached to the inner-race cleaning disc, an inner-race gear mounted on the inner shaft and rotatable together with the inner shaft, an idle gear engaged between the transmission gear and the inner-race gear, an outer shaft that is rotatable about a center axis of the inner shaft and is sleeved outside the inner shaft, the outer shaft being attached to the outer-race cleaning disc, and an outer-race gear mounted on the outer shaft and rotatable together with the outer shaft, the outer-race gear being engaged with the transmission gear, wherein:

the inner-race cleaning disc is surrounded by the outer-race cleaning disc, and the power mechanism actuates the inner shaft and the outer shaft to rotate in opposite directions via the inner-race gear, the outer-race gear, the transmission gear and the idle gear, causing the inner-race cleaning disc and the outer-race cleaning disc to spin in opposite directions.

2. The bidirectional-spin cleaning structure according to claim 1, wherein the driven gear and the transmission gear are co-axially arranged.

3. The bidirectional-spin cleaning structure according to claim 1, wherein:

the outer-race cleaning disc comprises an annular cleaning ring, a connecting plate is secured to an upper end of the cleaning ring, a through-hole configured for the inner shaft to pass through is provided in a center of the connecting plate, a connecting ring is secured to an upper end of the connecting plate, the cleaning ring, the through-hole, and the connecting ring are co-axially arranged, a lower end of the outer shaft is secured to the connecting ring, and the inner-race cleaning disc is surrounded by the cleaning ring.

4. The bidirectional-spin cleaning structure according to claim 3, further comprising a second transmission shaft, the idle gear being secured to the second transmission shaft.

5. The bidirectional-spin cleaning structure according to claim 1, wherein a lower end face of the inner-race cleaning disc is in-flush with a lower end face of the outer-race cleaning disc.

6. The bidirectional-spin cleaning structure according to claim 1, wherein the inner-race gear is secured to the inner shaft, and the outer-race gear is secured to the outer shaft.

* * * * *